US005371254A

United States Patent [19]

Lidert

[11] Patent Number: 5,371,254

[45] Date of Patent: Dec. 6, 1994

[54] PREPARATION OF EDIBLE NEEM OIL

[75] Inventor: Zev Lidert, Doylestown, Pa.

[73] Assignee: Rohm and Haas Company, Philadelphia, Pa.

[21] Appl. No.: 923,868

[22] Filed: Jul. 27, 1992

[51] Int. Cl.[5] ..... B11B 3/08

[52] U.S. Cl. ..... 554/182; 554/175; 554/181; 554/147; 554/141; 424/195.1; 424/196.1

[58] Field of Search ..... 554/175, 181, 147, 182; 424/195.1; 549/383; 562/561, 861; 208/208; 44/15; 423/228

[56] References Cited

U.S. PATENT DOCUMENTS 4,943,434 7/1990 Lidert ..... 514/453

OTHER PUBLICATIONS

Rukmini, Food Chemistry, vol. 26, pp. 119-124, 1987.

*Primary Examiner*—José G. Dees
*Assistant Examiner*—Deborah D. Carr
*Attorney, Agent, or Firm*—Clark R. Carpenter

[57] ABSTRACT

This invention relates to a new process for refining and deodorizing the oil from the seeds of the neem tree by refining a neem oil solution with an alkaline solution of hydrogen peroxide to provide an edible grade of vegetable oil.

16 Claims, No Drawings

PREPARATION OF EDIBLE NEEM OIL

FIELD OF THE INVENTION

This invention relates to a new process for refining and deodorizing the oil from the seeds of the neem tree (*Azadirachta indica Juss.*) to provide edible neem oil.

BACKGROUND OF THE INVENTION

The neem (or nim) tree is a subtropical tree which is native to the arid regions of India, Pakistan, Sri Lanka and parts of Southeast Asia and Western Africa. Once or twice a year, it bears a yellow, bitter fruit. The fruit contains a seed composed of a kernel and a husk. The kernel contains about 40 to 60% by weight neem oil. This oil can be isolated by standard procedures used in vegetable oil industry that involve expelling the oil in a cooker-prepress followed by extraction of the residual oil with hexane in a solvent extractor.

Neem oil has all the typical features of an edible, vegetable oil. It is composed of edible triglycerides anti non-edible or undesirable impurities such as phospholipids (gums), fatty acids, soaps, colored impurities, for example carotenoids and chlorophyll, and a host of other molecules. Such impurities are routinely removed in a typical refining process comprising the steps:

1. Degumming with water or an acid such as citric or phosphoric acid to remove phospholipids;.
2. Caustic refining with sodium hydroxide to remove fatty acids and soaps.
3. Absorption on beaching earth to remove colored materials.
4. Steam distillation to remove low molecular weight materials.

The first two steps of the refining process are most commonly carried out on raw oils stripped of hexene. However, for some oils, such as cotton oil, it is preferable to refine hexane solutions of the oil, for example 65% oil in hexane. As part of the refining process, the oils are commonly hydrogenated in order to improve their thermal and storage stability.

In order to be considered an edible product, the oil has to pass certain criteria. Some of these are chemical tests while others such as taste and smell are more arbitrary and are dependent on local cultures and conditions. The chemical tests include analysis of the fatty acid content of triglycerides. Erucic acid ($C_{20}$) and saturated acids such as palmitic ($C_6$) and stearic ($C_{18}$) are undesirable. Trace metals, chlorophyll, free fatty acids and phosphorous are also undesirable. Peroxide value. indicating stability towards oxidants, should be close to zero. Oils should be pale and their color is expressed by a standardized color index. In addition to these analyses. rape, mustard and canola oils are routinely assayed for sulfur which indicates the presence of glucosinolates. These compounds, occurring only in wild varieties, are catalyst poisons and therefore undesirable from the viewpoint of the refiners. More importantly, however, they lend the oil a specific odor and taste which are not popular with many consumers.

Analysis of crude neem oil suggests that it has the characteristics of a standard edible oil with regard to its fatty acid composition. Most of its impurities are of the standard, expected type except for sulfur, a very important exception. Two methods are in use for sulfur analysis the Inductively Coupled Plasma Atomic Emission Spectroscopy (ICP) analytical procedure and the Raney Nickel Reduction (Ra(Ni)) method. The ICP method is very rapid and convenient, but the industry standard in North America, <1 part per million (ppm) for canola, is based on the older and rather cumbersome Ra(Ni) method which routinely gives values ten times lower than those obtained using the ICP method. The ICP and Ra(Ni) analytical procedures are described in "Sulfur Levels in Canola Oils from Canadian Crushing Plants Analysis by Raney Nickel Reduction and Inductively Coupled Plasma Atomic Emission Spectroscopy," *Proceedings of the GCIRC Eighth International Rapeseed Congress, Jul.* 9, 1991, *Saskatoon, Sask., Canada, Vol.* 5, page 1396, D. I. McGregor, ed., published by the Organizing Committee of the Eighth International Rapeseed Congress under the Auspices of the Groupe Consultatif International de Recherche sur le Colza (GCIRC) and the Canola Council of Canada, the disclosure of which is incorporated by reference herein. The sulfur content in neem oil is very high, 2200 ppm, using the ICP analytical procedure, and consequently imparts a very disagreeable odor and taste to the neem oil All sulfur values reported in the specification and in the claims were obtained using the ICP method for sulfur analysis unless otherwise indicated.

Standard vegetable oil refining steps do not reduce the sulfur content down to an acceptable level in neem oil, although the other typical impurities are removed. Hydrogenation, to improve oil stability, was not possible due to the poisoning of the hydrogenation catalyst by the sulfur. This failure of the standard refining methodology may account for the lack of interest by food producers in neem oil.

C. Rukmini, *Food Chemistry* 26, 119–124 (1987) discloses a debitterized neem oil. However, the details for obtaining such debitterized neem oil are not revealed.

SUMMARY OF THE INVENTION

It is an object of the present invention to provide a new process for the preparation of an edible grade, of neem oil that is odor-free and that possesses a sulfur content of less that. 1550 ppm.

It is a further object to provide such a process which can be easily employed in existing standard refining procedures used by the producers of vegetable oils.

It has now been discovered that an edible neem oil which possesses the aforementioned desirable properties can be produced by refining a neem oil solution with an alkaline solution of hydrogen peroxide.

DETAILED DESCRIPTION OF THE INVENTION

A scalable process for the production of an odor-free, edible grade of neem oil, containing less than 1550 ppm of sulfur, has been devised which can be easily accomodated into a typical refining process as indicated in Table 1 using, for example, 65 parts of oil in 35 parts of an alkane on a weight/weight (w/w) basis.

TABLE 1

Standard Sequence for Refining Oils in Hexane

1. Caustic refining to remove free fatty acids.
2. Water wash to remove soaps and gums.
3. Hexane strip.
4. Hydrogenation for stabilization.
5. Bleaching to remove colored materials using bleaching earth with activated carbon.

6. Deodorization to remove lower molecular weight materials by steam distillation.

This Invention

1. Dissolve crude neem oil in an alkane.
2. Treat the alkane/neem oil solution with hydrogen peroxide/caustic/alcohol refining to remove free fatty acids and most sulfurous materials.
3. Water wash or filtration through silica of the alkane solution to remove soaps and gums.
4. Alkane strip.
5. Bleaching to remove colored materials using bleaching earth with activated carbon.
6. Purifying by distillation or chromatography to remove lower molecular weight impurities including sulfurous materials, preferably by steam distillation.
7. Hydrogenation for oil stabilization.
8. Deodorization to remove lower molecular weight materials by steam distillation.

Although the steps following the hydrogen peroxide/caustic/alcohol refining step of the present invention process are listed in the particular order as shown in Table 1, other sequences of steps would also yield edible neem oil. For example, the water wash or filtration through silica of step 3 may be performed after the alkane strip of step 4. In another example, the bleaching process of step 5 may be performed after the hydrogenation of step 7. In yet another example, the purification of step 6 may be performed prior to the bleaching process of step 5.

The choice of an alkaline solution of hydrogen peroxide for the removal of sulfur containing compounds from neem oil was based on the theory that the majority of such compounds would have a disulfide linkage and therefore could be oxidized to water soluble sulfates. The presence of an alcohol allows the sulfur containing compounds to be solubilized in the aqueous phase. This can be shown, using sodium hydroxide as the base, as folio, yes

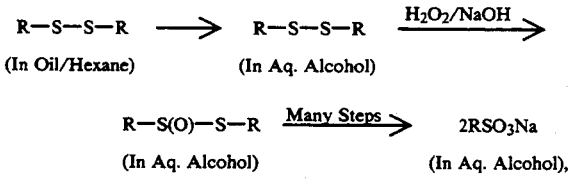

wherein R represents an organic moiety.

This invention comprises a process for the preparation of odor free, edible neem oil having low sulfur content, such as a sulfur content below 1550 ppm, which comprises 1. dissolving crude neem oil in an alkane such as heptane, hexane and the like;
2. treating the alkane solution with from about 10 milliliters (mL) to about 100 mL, preferably from about 40 mL to about 90 mL, of an alkaline solution of hydrogen peroxide optionally in the presence of an alcohol, such as a sodium hydroxide solution of hydrogen peroxide in ethanol, per 100 grams (g) of the alkane solution at a temperature range of from about 30° C. to about 70° C., preferably in the rang, of from about 45° C. to about 60° C.;
3. isolating the alkane solution and washing or filtering or both if desired;
4. removing the alkane to obtain low sulfur containing crude neem oil;
5. purifying the crude neem oil by distillation, preferably steam distillation, or by chromatographic methods; followed by, if desired,
6. hydrogenating, bleaching and further purification.

The neem oil may be derived from either refined neem oil or neem oil which has been previously caustic refined. The solution of hydrogen peroxide comprises hydrogen peroxide, a base, for example sodium hydroxide, potassium hydroxide or a mixture thereof, and, optionally, an alcohol, for example methanol or, more preferably, ethanol.

Various proportions of neem oil and alkane may be employed. A preferred amount of neem oil in the alkane solution is from about 50% to about 80%, more preferably about 65%, neem oil on a w/w basis.

The hydrogen peroxide solution was made up from about one part of aqueous 35% hydrogen peroxide solution and about ten parts of an alcoholic solution of an alkaline material on a volume/volume (v/v) basis. The alkaline material comprised about 1% on a w/w basis of the alcoholic solution of the alkaline material.

In a preferred embodiment of this invention, 65 parts of unrefined or previously caustic refined neem oil in 35 parts of hexane on a w/w basis is treated with a solution comprising hydrogen peroxide, sodium hydroxide and ethanol. The concentration of hydrogen peroxide in the solution is from about 0.1% to about 15% on a w/w basis; the concentration of sodium hydroxide in the solution is from about 0.05% to about 5%, more preferably from about 0.5% to about 3%, and even more preferably from about 1.(1%% to about 3.0% on a w/w basis; and the concentration of ethanol is from 0% to about 75%, more preferably from about 25% to about 70%, and even more preferably from about 50% to about 70% on a w/w basis. The neem oil which resulted from this treatment, after a water wash to remove soaps and gums followed by a hexane strip, possessed not more than 1550 ppm of sulfur, more preferably not more than 800 ppm of sulfur, and even more preferably not more than 500 ppm of sulfur.

The neem oil which results from the hydrogen peroxide treatment may be further processed by subjecting it to a steam distillation to remove lower molecular weight materials, including sulfur containing materials, to provide a neem oil containing less than 200 pm of sulfur. This deodorized neem oil may be partially hydrogenated in order to enhance its stability and to provide a neem oil containing less than 100 ppm of sulfur. If desired, this partially hydrogenated oil may be subjected to a bleaching step, using bleaching earth with activated carbon in order to remove colored impurities, and a deodorization step to remove residual lower molecular weight materials in order to provide a neem oil containing not more than 50 ppm of sulfur.

The following examples are provided to illustrate the process of this invention but are not intended to limit the scope thereof.

Experimental Examples 1–14: Treatment of Unrefined or Refined Neem Oil in Hexane with Alkaline Hydrogen Peroxide Solutions Examples 1–12 were experiments run on 100 g of a caustic refined, 65% by weight solution of neem oil, containing 1650 ppm of sulfur, in hexane. Examples 13 and 14 were experiments run on 100 g of an unrefined, 65% by weight solution of neem oil, containing 220,)

ppm of sulfur, in hexane. The alkaline solutions of hydrogen peroxide were prepared from aqueous 35% hydrogen peroxide, aqueous ethanol ($C_2H_5OH$) and aqueous 2%, 4%, 8% or 16% sodium hydroxide (NaOH) solutions in the proportions listed in Table 2. The hexane solution of neem oil and the alkaline solution of hydrogen peroxide (11202) were stirred together for 30 minutes at 50°-55° C., the phases separated by centrifugation, and the hexane solution of neem oil phase stripped of hexane and analyzed for sulfur.

TABLE 2

$H_2O_2$ REAGENT CONCENTRATIONS AND RESULTING SULFUR LEVEL FOR EXAMPLES 1-14

| Ex. | COMPONENTS of ALKALINE $H_2O_2$ REAGENT | | | | | |
|---|---|---|---|---|---|---|
| | NaOH | | % | % | Total | ppm |
| No. | % | g | $C_2H_5OH$ | $H_2O_2$ | mL | of Sulfur |
| 1 | 0.5 | 0.1 | 50 | 8.75 | 20 | 1260 |
| 2 | 0.25 | 0.05 | 50 | 8.75 | 20 | 1425 |
| 3 | 0.05 | 0.01 | 50 | 8.75 | 20 | 1504 |
| 4 | 0.25 | 0.05 | 25 | 8.75 | 20 | 1488 |
| 5 | 0.25 | 0.05 | 62.5 | 8.75 | 20 | 1408 |
| 6 | 0.25 | 0.03 | 0 | 8.75 | 20 | 1500 |
| 7 | 0.5 | 0.2 | 62.5 | 8.75 | 40 | 1030 |
| 8 | 1.0 | 0.4 | 62.5 | 8.75 | 40 | 684 |
| 9 | 2.0 | 0.8 | 62.5 | 8.75 | 40 | 445 |
| 10 | 1.0 | 0.8 | 62.5 | 8.75 | 80 | 590 |
| 11 | 2.0 | 1.6 | 62.5 | 8.75 | 80 | 375 |
| 12 | 1.0 | 0.4 | 68.75 | 8.75 | 40 | 606 |
| 13 | 1.9 | 1.6 | 60 | 10.3 | 85 | 265 |
| 14 | 2.7 | 1.6 | 42 | 14.6 | 60 | 469 |

Example 15: Large Scale Experiment Using the Parameters of Example 11 .

A solution made up of 65% by weight of caustic refined neem oil in hexane, 2000 g total, was treated with 1600 ml of alkaline hydrogen peroxide solution according to the conditions of Example 11. The total weight of sodium hydroxide present in the alkaline hydrogen peroxide solution was 32 g. The weight concentrations of the NaOH, $C_2H_5OH$ and $H_2O_2$ components of the alkaline hydrogen peroxide reagent were 2.0%, 62.5% and 8.75%, respectively, as in Example 11. After work up according to the procedure of Example 11, the neem oil was analyzed for sulfur and found to contain 268 ppm of sulfur.

Example 16 Deodorization and Bleaching of the Need Oil from Example 15

The neem oil resulting front the alkaline hydrogen peroxide treatment of Example 15 was filtered through silica to remove soaps. This was followed by bleaching on bleaching earth mixed with activated carbon at 110° C. and reduced pressure (28 inches of Hg). The bleached and filtered neem oil was analyzed and found to contain 174 ppm of sulfur.

The bleached and filtered oil was next subjected to a two hour deodorization step with 3% by weight of steam per hour at 255° C. and 4 mm of Hg pressure. The once deodorized neem oil was analyzed and found to contain 77 ppm of sulfur.

The once deodorized neem oil was hydrogenated for 30 minutes using a 2% by weight standard nickel on kiselghur catalyst. The resulting partially hydrogenated neem oil had a melting point of 43° C. and a sulfur content of 45 ppm.

The partially hydrogenated neem oil was subjected to a second deodorization step using the conditions noted above for the first deodorization step. The resulting completely treated neem oil was analyzed for sulfur and found to contain 44 ppm using the ICP analytical method and 4 ppm using the Ra(Ni) analytical method and was colorless and odorless.

Example 17 Use of Methanol in the Alkaline Solution of Hydrogen Peroxide

One part, by weight, of an unrefined 65% (w/w) neem oil in hexane solution was treated with one part of an alkaline solution of hydrogen peroxide prepared from 1 part of aqueous 35% $H_2O_2$ and 10 parts of methanolic 1% sodium hydroxide (v/v) for 30 minutes at 45°-55° C. Analysis for sulfur indicated that the sulfur content of the neem oil was reduced frown an initial value of 2200 ppm of sulfur to 95 ppm of sulfur.

It should be understood that the instant specification and examples are set forth by way of illustration and not limitation and that various modifications and changes may be made without departing from the spirit and scope of the present invention as defined by the appended claims.

I claim:

1. A process for the preparation of odor-free and edible neem oil containing less than 15150 ppm of sulfur which comprises:

a. dissolving crude neem oil in art alkane, b. treating the alkane solution with an alkaline solution of hydrogen peroxide, c. isolating the alkane solution, d. removing the alkane to obtain low sulfur containing crude neem oil, e. purifying the chide neem oil by distillation or by chromatographic methods, followed by, if desired, f. hydrogenating, bleaching and further purification.

2. The process of claim I wherein the alkane is hexane.

3. The process of claim 2 wherein the hexane solution of neem oil comprises about 35% hexane and about 65% neem oil by weight.

4. The process of claim 1 wherein the alkaline solution of hydrogen peroxide further comprises hydrogen peroxide, an alkaline material and an alcohol.

5. The process of claim 4 comprising about 35% by weight of hydrogen peroxide, an alcoholic solution and about 1% by weight of an alkaline material.

6. The process of claim 4 wherein the alcohol is methanol or ethanol.

7. The process of claim 5 wherein the alkaline material is sodium hydroxide, potassium hydroxide or a mixture of sodium and potassium hydroxide.

8. The process of claim 2 wherein the neem oil in tile hexane solution of neem oil is derived from unrefined neem oil or from caustic refined neem oil.

9. The process of claim 4 wherein the hydrogen peroxide solution comprises hydrogen peroxide, sodium hydroxide and ethanol.

10. The process of claim 9 wherein from about 10 mL to about 100 mL of the hydrogen peroxide solution comprising from about 0.1% to about 15% by weight of hydrogen peroxide, from about 0.05% to about 5% by weight of sodium hydroxide, and from 0% to about 75% by weight of ethanol is utilized per 100 g of an alkane solution of neem oil.

11. The process of claim 10 wherein from about 40 mL to about 90 mL of the hydrogen peroxide solution comprising from about 0.1% to about 15% by weight of hydrogen peroxide, from about 1% to about 3% by weight of sodium hydroxide, and from about 50% to about 70% by weight of ethanol is utilized per 100 g of a hexane solution of neem oil.

12. The neem oil resulting from the process of claim 1 or 2 wherein said neem oil contains not more than 1500 ppm of sulfur.

13. The neem oil resulting from the process of claim 10 wherein said neem oil contains not more than 800 ppm of sulfur.

14. The neem oil resulting from the process of claim 11 wherein said neem oil contains not more than 500 ppm of sulfur.

15. The neem oil resulting from the process of claim 11 wherein said neem oil is purified by steam distillation to provide a purified neem oil containing not more than 200 ppm of sulfur.

16. The purified neem oil resulting from the process of claim 15 wherein said neem oil is hydrogenated and bleached to provide an odor-free and edible neem oil containing not more than 50 ppm of sulfur.

* * * * *

UNITED STATES PATENT AND TRADEMARK OFFICE

CERTIFICATE OF CORRECTION

PATENT NO. : 5,371,254

DATED : December 6, 1994

INVENTOR(S) : Zev Lidert

It is certified that error appears in the above-identified patent and that said Letters Patent is hereby corrected as shown below:

Col. 1, l. 21: Replace "anti" with --and--
Col. 1, l. 36: Replace "hexene" with --hexane--
Col. 1, l. 51: Replace "value." with --value,--
Col. 1, l. 54: Replace "analyses." with --analyses,--
Col. 1, l. 66: Replace "sis the" with --sis: the--
Col. 3, l. 41: Replace "folio, yes" with --follows:--
Col. 3, l. 65: Replace "rang," with --range--
Col. 4, l. 33: Replace "1.(%%" with --1.0%--
Col. 4, l. 47: Replace "pm" with --ppm--
Col. 4, l. 68: Replace "220,)" with --2200--
Col. 5, l. 03: Replace "aqueous ethanol" with --aqueous 95% ethanol--
Col. 5, l. 07: Replace "(11202)" with --H2O2--
Col. 5, l. 47: Replace "16 Deodorization" with --16: Deodorization--
Col. 5, l. 47: Replace "Need" with --Neem--
Col. 6, l. 24: Replace "15150" with --1550--
Col. 6, l. 26: Replace "art" with --an--
Col. 6, l. 33: Replace "chide" with --crude--
Col. 6, l. 52: Replace "tile" with --the--

Signed and Sealed this

Twenty-sixth Day of September, 1995

*Attest:*

Bruce Lehman

BRUCE LEHMAN

*Attesting Officer*

*Commissioner of Patents and Trademarks*